US006891453B2

(12) United States Patent
Castonguay et al.

(10) Patent No.: US 6,891,453 B2
(45) Date of Patent: May 10, 2005

(54) CIRCUIT BREAKER MECHANISM

(75) Inventors: Roger Castonguay, Terryville, CT (US); Randy Greenberg, Granby, CT (US); Dennis Doughty, Plainville, CT (US); Dave S. Christensen, Burlington, CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/248,608

(22) Filed: Jan. 31, 2003

(65) Prior Publication Data

US 2003/0098224 A1 May 29, 2003

Related U.S. Application Data

(62) Division of application No. 09/681,592, filed on May 3, 2001, now Pat. No. 6,552,637, which is a continuation of application No. 09/427,561, filed on Oct. 26, 1999, now Pat. No. 6,317,018.

(51) Int. Cl.[7] ..... H01H 75/00
(52) U.S. Cl. ..... 335/8; 335/172
(58) Field of Search ..... 335/8–10, 165–176, 335/23–25, 6, 132, 202

(56) References Cited

U.S. PATENT DOCUMENTS

| | | | | | |
|---|---|---|---|---|---|
| 2,060,472 | A | | 11/1936 | Sadin | |
| 2,067,935 | A | * | 1/1937 | Lingal | 335/9 |
| 3,767,871 | A | * | 10/1973 | Strobel | 200/50.32 |
| 4,079,345 | A | | 3/1978 | Pietsch | |
| 4,600,908 | A | * | 7/1986 | Uchida et al. | 335/8 |
| 4,879,535 | A | | 11/1989 | Mori et al. | |
| 5,281,776 | A | | 1/1994 | Morel et al. | |
| 5,357,066 | A | | 10/1994 | Morel et al. | |
| 5,713,459 | A | | 2/1998 | Beck et al. | |
| 6,317,018 | B1 | * | 11/2001 | Castonguay et al. | 335/8 |
| 2001/0017580 | A1 | | 8/2001 | Castonguay et al. | 335/9 |

* cited by examiner

*Primary Examiner*—Lincoln Donovan
(74) *Attorney, Agent, or Firm*—Cantor Colburn LLP

(57) ABSTRACT

A mechanism for operating a plurality of circuit interruption mechanisms of a circuit breaker, the mechanism applies a uniform force to the circuit interruption mechanisms. The mechanism applies a force to an elongated member for manipulating the circuit interruption mechanisms. The mechanism applies a force to the elongated member at a first position and a second position, the first position and the second position being intermediate to a center of the elongated member and the plurality of circuit interruption mechanisms.

7 Claims, 11 Drawing Sheets

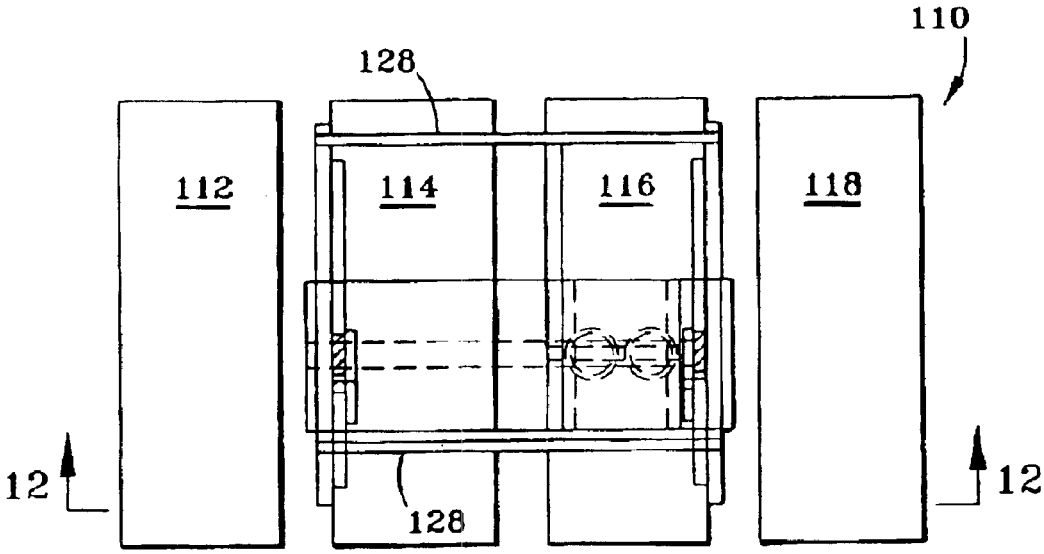
FIG. 11
FIG. 12
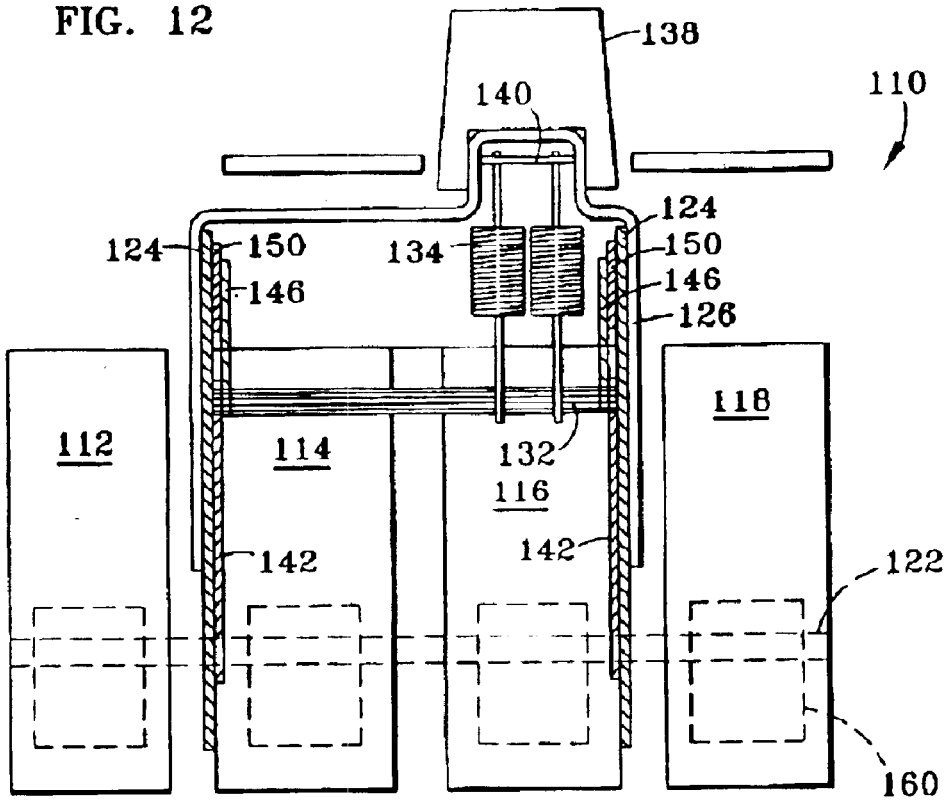

CIRCUIT BREAKER MECHANISM

CROSS REFERENCE TO RELATED APPLICATIONS

This application is a divisional of U.S. patent application Ser. No. 09/681,592 filed on May 3, 2001, now U.S. Pat. No. 6,552,637, which is a continuation of U.S. Ser. No. 09/427,561 filed on Oct. 26, 1999 now U.S. Pat. No. 6,317,018 issued Nov. 13, 2001, the contents of which are incorporated herein by reference thereto.

BACKGROUND OF THE INVENTION

This invention relates to an operating mechanism for a four-pole electrical breaking apparatus, namely, a four pole circuit breaker having the first three poles associated with the three phases of an electrical supply system and the fourth pole being associated with the neutral.

Generally, four pole circuit breakers are usually derived from a three pole design. Accordingly, the mechanism for controlling the opening, closing and resetting of the circuit breaker is, in the case with a three pole design, associated with the center pole. In such a design, the operating mechanism is positioned over the center pole and, accordingly, the force of the mechanism is applied on either side of the center pole. This design allows the forces from the mechanism to be distributed symmetrically on either side of the center pole.

However, as a fourth pole is added to such a configuration, the forces are no longer distributed symmetrically. This asymmetry gives rise to problems of unbalanced loading at the fourth pole. This unbalanced loading is caused by the flexing or bending of the crossbar, which is magnified at the fourth pole. This bending and/or flexing will contribute to a loss of motion, and accordingly, a lower contact pressure being applied by the crossbar at the pole furthest from the mechanical mechanism.

U.S. Pat. No. 4,383,146 and 5,357,066 both offer a proposed solution to the above-mentioned problems. However, both patents require significant modifications to the controlling mechanism, including the incorporation of a secondary mechanism, as well as modifications to the fourth pole.

BRIEF DESCRIPTION OF INVENTION

In an exemplary embodiment of the present invention a circuit breaker controlling mechanism is configured to apply a symmetrical force to the circuit interruption mechanism corresponding to each of the poles in a circuit breaker. The circuit breaker controlling mechanism is configured to apply its mechanical force at locations that will result in an evenly distributed force.

In another exemplary embodiment of the present invention, a controlling mechanism for applying and evenly distributing a force to a four phase circuit breaker requires a minimal amount of design change from the mechanism that is used for a three pole circuit breaker.

In another exemplary embodiment of the present invention, a controlling mechanism is configured to withstand a higher loading force and, therefore, apply a larger force to the circuit interruption mechanism of a circuit breaker.

In yet another exemplary embodiment of the present invention, the controlling mechanism is configured to align with a controlling mechanism of a three phase circuit breaker.

BRIEF DESCRIPTION OF THE DRAWINGS

FIG. 11 is a top plan view of an alternative embodiment of the present invention;

FIG. 12 is a view along lines 12—12 of the FIG. 11 embodiment.

DETAILED DESCRIPTION OF THE INVENTION

Generally, four pole circuit breakers are usually derived from a three pole design. Accordingly, the mechanism for controlling the opening, closing and resetting of the circuit breaker is, in the case of a three pole design, positioned to be placed over the center pole. This design causes the lateral forces of the controlling mechanism in a three pole design to be distributed symmetrically on either side of the center pole.

However, and as a fourth pole is added to such a configuration, the lateral forces are no longer distributed symmetrically. This asymmetry gives rise to an unbalanced loading situation, which is due to the bending and for the flexing up the crossbar.

In order to close the circuit breaker a considerable amount of force is exerted upon the crossbar. Such forces will cause the crossbar to bend and/or flex.

This bending and/or flexing will cause a loss of motion at a position furthest from the controlling mechanism. Accordingly, the pole furthest from the controlling mechanism receives a lower contact force and contact depression than the other poles. This unbalanced loading will prevent the fourth pole from carrying a current or result in a higher contact temperature if the fourth pole is able to carry a current. This higher contact temperature is a result of a higher resistance at the fourth pole due to a lower contact force and for contact depression.

Figure 1:
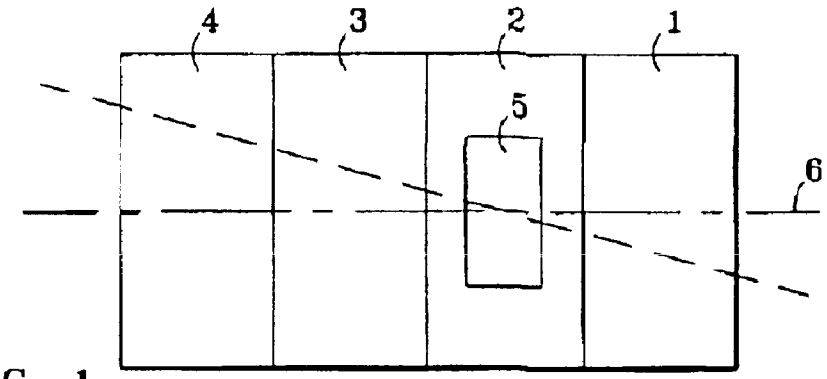
FIG. 1 PRIOR ART
FIG. 1 is a view of the prior art.

Such an asymmetrical loading of the prior art is illustrated in FIG. 1. Here, three phases 1, 2 and 3 and a neutral 4 have a single mechanism 5 for applying a mechanical force to a crossbar 6.

As illustrated by the dashed lines in FIG. 1, and as a force is applied to crossbar 6 by mechanical mechanism 5, crossbar 6 will tend to bend, and accordingly, an uneven or weaker force will be applied to neutral 4. This will result in neutral 4 being susceptible to a lower, or undesired, contact force and less contact depression.

Figure 2:
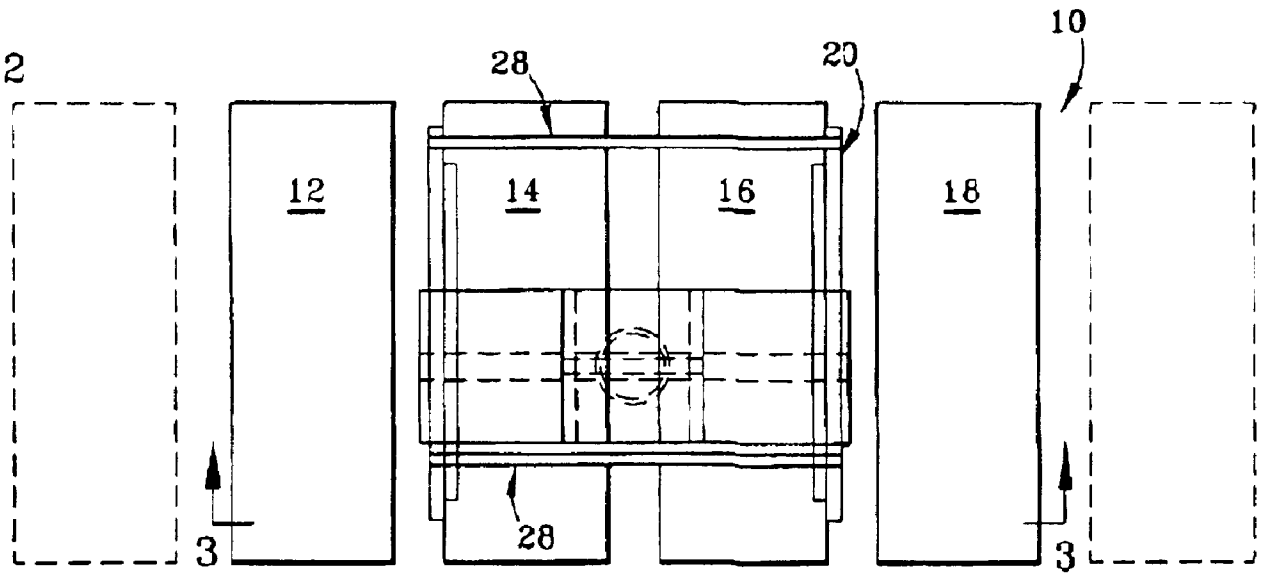
FIG. 2 is a top plan view of the present invention.

Referring now to FIG. 2, a circuit breaker 10 is illustrated. Circuit breaker 10 comprises a plurality of cassettes 12, 14, 16 and 18 each of which represents a pole of circuit breaker 10. Cassettes 12, 14, 16 and 18 each are adapted for connection with an associated electrical distribution system and a protected electric circuit. Moreover, cassettes 12, 14, 16 and 18 each contain a means and/or mechanism to interrupt the electrical circuit.

Generally, a four-pole circuit breaker comprises three phases and a neutral conductor.

As contemplated with the present invention, cassettes 12, 14 and 16 represent the three phases of the circuit breaker while cassette 18 represents the neutral. Alternatively, and as an application of circuit breaker 10 may require, cassettes 14, 16 and 18 represent the three phases of the circuit breaker while cassette 12 represent the neutral.

This feature is a particular importance in international applications wherein regulatory requirements and/or industry applications of different countries require the positioning of the neutral to be on either end of circuit breaker 10.

In order to affect the opening, closing and/or reset of circuit breaker 10, and accordingly the circuit interruption mechanism of cassettes 12–18, an operating mechanism 20 applies a force to a crank pin 22. Crank pin 22 is an elongated member that is received and passes through each circuit mechanism of cassettes 12–18. As a force is applied to crank pin 22, the force is transferred to the circuit interruption mechanisms of cassettes 12–18.

Referring now in particular to FIGS. 2–10, operating mechanism 20 comprises, among other elements, a pair of side frames 24, a handle yoke 26, a plurality of frame pins 28, a pair of linkage mechanisms 30 and a toggle pin 32.

Linkage mechanisms 30 assists and transferring a user applied force from handle yoke 26 to crossbar 22. This force will open, close and/or reset a circuit interruption mechanism 21 of cassettes 12, 14, 16 and 18.

Linkage mechanisms 30 are configured to receive and apply to crossbar 22 a force from handle yoke 26. Accordingly, and as a user applied force is exerted upon handle yoke 26, linkage mechanisms 30 provide a force to crossbar 22.

Figure 8:
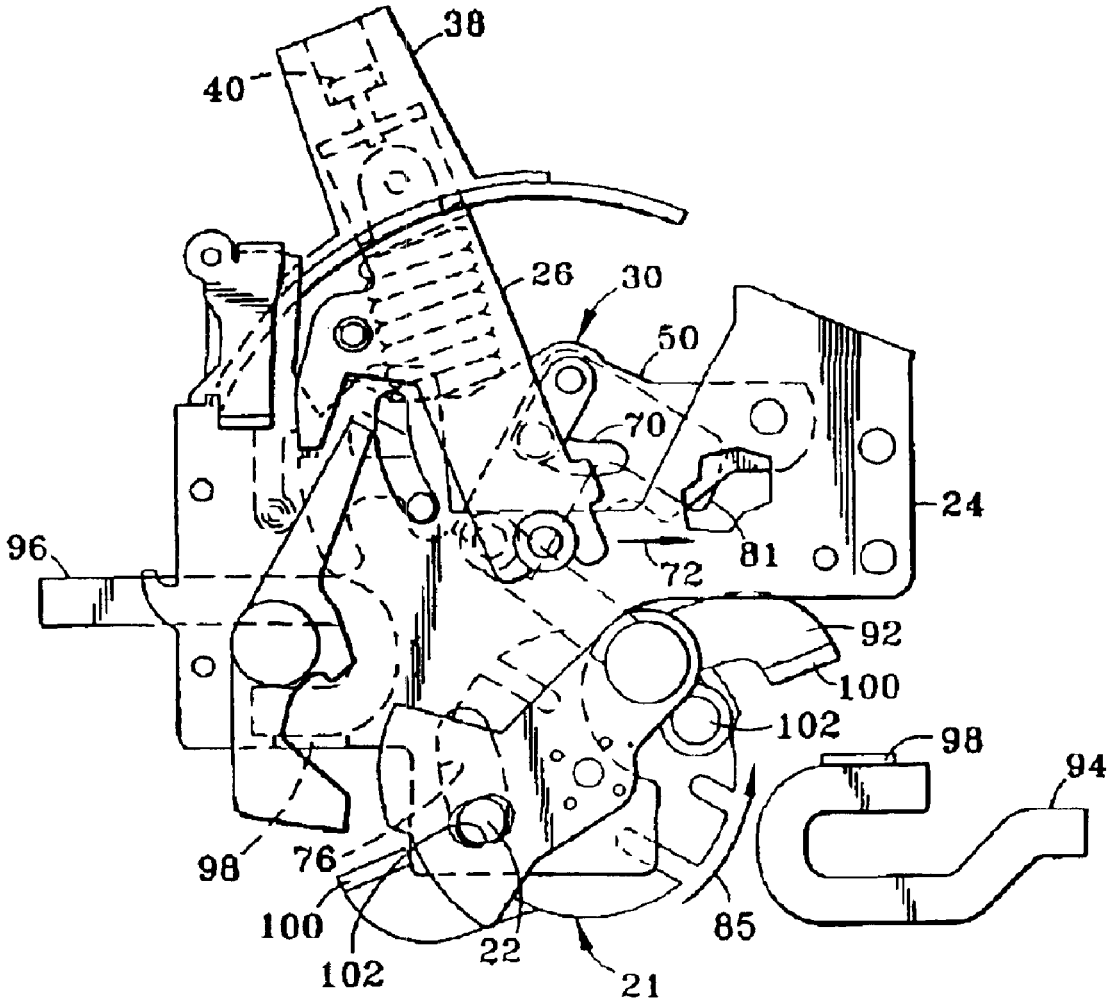
FIG. 8 is a side elevation view illustrating the present invention in an open configuration.
Figure 9:
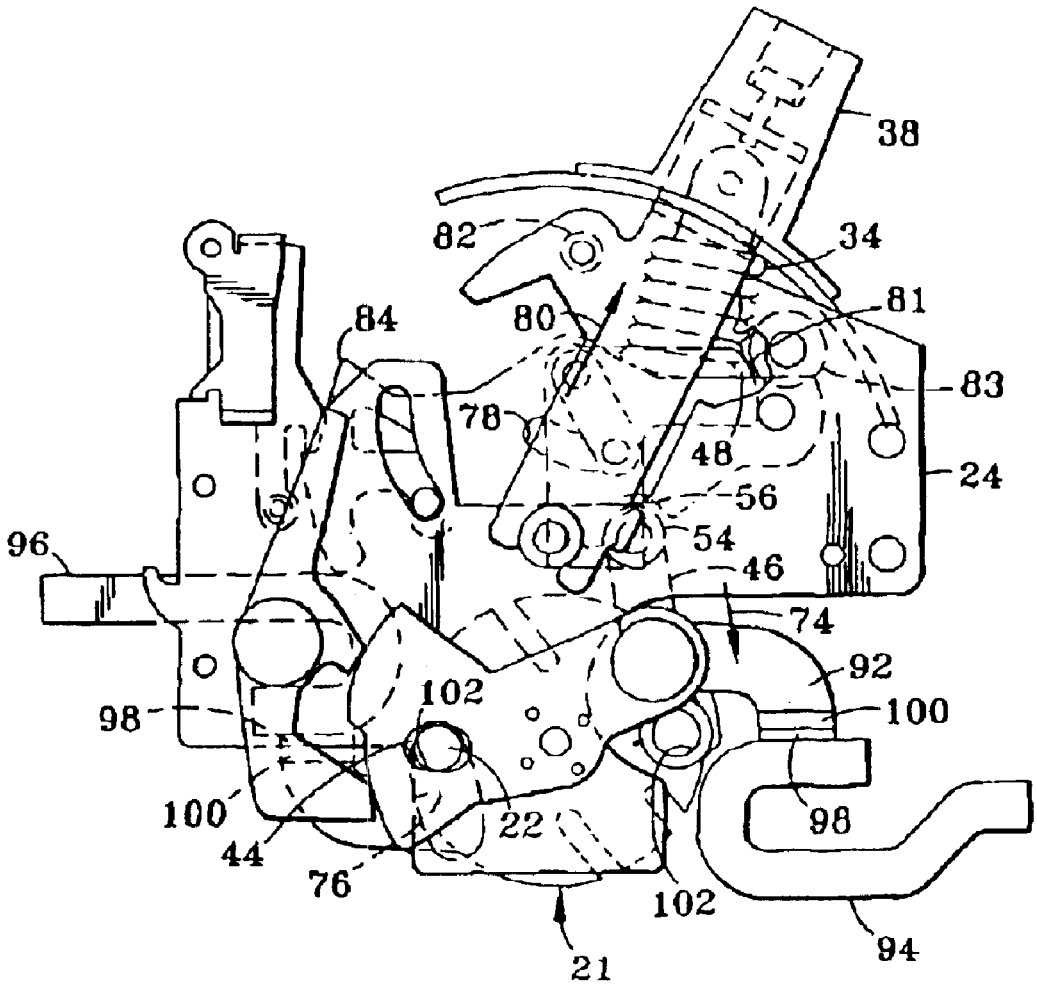
FIG. 9 is a side elevation view illustrating the present invention in a closed position.
Figure 10:
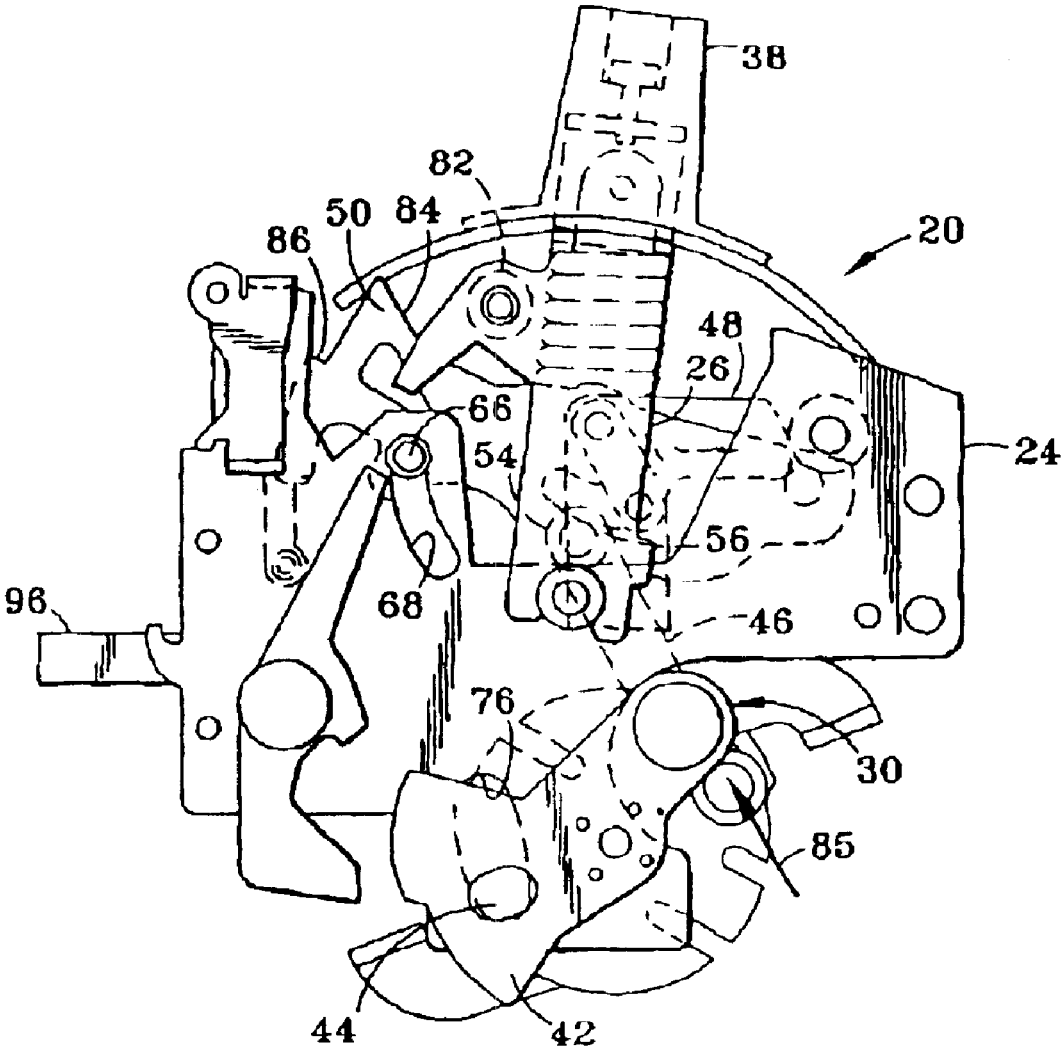
FIG. 10 is a side elevation view illustrating the present invention in a tripped position.

FIGS. 8, 9 and 10 illustrate operating mechanism 20, as well as circuit interrupter mechanism 21, in an open, closed and tripped position respectively. Circuit interrupter mechanism 21 is described in co-pending U.S. patent application Ser. No. 09/108,684, the contents of which are incorporated herein by reference.

In addition, and as operating mechanism 20 is moved to a closed position from either an open position or reset from a tripped position, a spring 34 is extended so as to provide an urging force for maintaining circuit breaker 10, and accordingly the circuit interrupter mechanism 21 of cassettes 12–18, in a closed position. Spring 34 is secured to a pin 36 at one end and toggle pin 32 at the other.

In addition, spring 34 is biased to also provide an urging force for opening and or tripping circuit interrupter mechanism 21.

A handle 38, for manipulation by a user, is secured to the upper portion of handle yoke 26 through the use of a screw 40.

Referring now in particular to FIGS. 5–10, linkage mechanisms 30 each have a crank 42. Crank 42 is mounted to sidewall 24 for movement in response to a force received as the position of handle yoke 26 is altered. In the preferred embodiment, cranks 42 are mounted to sidewalls 24 by a pin 43. The securement of crank 42 to sidewall 24 allows crank 42 to rotate about a point on sidewall 24. Cranks 42 each have an opening 44. Openings 44 are of a sufficient size to allow crank pin 22 to pass through. Openings 44 engaged crank pin 22 as cranks 42 are rotated.

Cranks 42 are also secured to a pair of lower link members 46. Lower link members 46 are pivotally secured to cranks 42 through the use of a pin 45. Pin 45 passes through a spacer or washer 47 that is positioned in between lower link members 46 and cranks 42. In the preferred embodiment, washer 47 has a thickness substantially the same as sidewall 24. Washer 47 allows lower link member 46 to pivot without interference from sidewall 24. Alternatively, lower link 46 or crank 42 can be configured to have a sleeve having a thickness substantially the same as sidewall 24 through which pin 45 will pass.

In yet another alternative, crank 42 and lower link member 46 are mounted to the same side of sidewall 24 thereby eliminating the need for washer 47.

At its opposite end, lower link members 46 are each pivotally secured to an upper link member 48. Each upper link member 48 is also pivotally secured to a cradle 50. Each upper link member 48 has an annular collar 52 positioned to receive the ends of toggle pin 32. Collar 52 is positioned so that the ends of toggle pin 32 axially align with the point of securement between lower link 46 and upper link 48.

In addition, lower link 46 is configured to have an annular surface 54 positioned along the periphery of the end of lower link 46 that is pivotally secured to upper link 48. Annular surface 54 of lower links 46 makes contact with an engagement surface 56 of cradles 50.

Each upper link 46 is pivotally mounted to each cradle 50 through the use of a pair of pins 58 and a securement member 60. Each cradle 50 is mounted to sidewall 24 through the use of a cradle mounting pin 62, which has a pair end portions 64 that pass through openings in cradles 50 and sidewalls 24. The diameter of cradle mounting pin 62 is substantially larger than at that of end portions 64. Accordingly, cradle mounting pin 62 pivotally secures cradles 50 to sidewalls 24.

In addition, a guide pin 66 is secured to each cradle 50 and passes through an elongated opening 68 in sidewalls 24. Guide pin 66 is configured to have an end portion 70. End portion 70 is substantially larger than elongated opening 68. In accordance with operational aspects of the present invention guide pin 66 travels through opening 68 as cradle 50 travels in the directions illustrated by FIGS. 8 and 10.

Accordingly, and referring in particular to FIGS. 8 and 9, the movement of operation mechanism 20 is illustrated. As handle 38 is manipulated into the position illustrated by FIG. 9 or the "closed position" the portions of lower link members 46 and upper link members 48 which are pivotally secured to each other are urged, generally, in the direction of arrow 72. This ultimately results in lower link 46 and upper link 48 being locked into the position illustrated by FIG. 9. This position causes a force to be applied to crank 42 in the direction of arrow 74.

In addition, the force in the direction of arrow 74 causes crank 42 to rotate in a direction that causes opening 44 of crank 42 to make contact with crank pin 22. Accordingly, crank pin 22 travels through an elongated opening 76 in sidewalls 24. The movement of crank pin 22 also causes circuit interruption mechanism 21 to rotate into a closed or current carrying position.

In addition, and as handle 38 is moved from the open position to the closed position (FIG. 8 to FIG. 9), annular surface 54 of upper link 48 makes contact with engagement surface 56 of crank 50. An elongated opening 78 in cradle 50 allows pin 58, and accordingly upper link 48, to move in the direction of arrow 72. In addition, the securement of member 60 to upper link 46 provides stability to upper link 46 as it travels in accordance with the movement of handle 38.

Additionally, and as handle 38 is moved into the closed position, spring 34 which is secured to toggle pin 32 at one end and pin 36 at the other is stretched, and accordingly biased, to provide a locking or closing force upon lower link 46 and upper link 48 generally in the direction of arrow 80. It is also noted that as handle 38 is manipulated into the closed position, engagement surface 56 is configured so that annular surface 54 will be seated within engagement surface 56 of crank 50 (FIG. 9). Annular surface 54 and engagement surface 56 are configured to prevent upper link 46 from moving any further in the direction of arrow 72 which would result in lower link 46 and upper link 48 no longer being in the closed or "locked" position illustrated in FIG. 9.

Referring now in particular to FIG. 10, mechanism 20 is in a "tripped" position. Here, the electromagnetic force generated by the current flowing through circuit interrupter mechanism 21 has, in accordance with predetermined tolerances, overcome the mechanical forces of operating mechanism 20 which maintain circuit interruption mechanism 21 in a closed position (FIG. 9).

Under fault or tripping conditions, a trip unit (not shown) causes the biasing force of spring 34 in the direction of arrow 85 to urge cradle 50 upward to the position illustrated in FIG. 10. In addition, upper link 48 is configured to have a cam surface 81 that a makes contact with a spacer pin 83 this causes annular surface 54 to make contact with engagement surface 56, and accordingly, urge cradle 50 upward. Accordingly, guide pin 66 travels through elongated opening 68 in sidewalls 24.

In order to close circuit interrupter mechanism 21 after it has been tripped, handle 38 must be urged into the open position illustrated in FIG. 8. In response to this movement of a reset pin 82 of handle yoke 26 makes contact with a graduated surface 84 of cradle 50. Accordingly, surface 84 of cradle is urged back downwards and guide pin 66 travels back down through elongated opening 68 in sidewalls 24. This movement causes a shoulder portion 86 of cradle 50 to be engaged by a pair of tab portions 88 which extend outwardly frown a primary latch 90. (FIGS. 4, 8 and 10) Primary latch 90 is spring biased to urge tabs 88 into shoulder portions 86 of cradles 50, as cradles 50 are urged downward. This movement and corresponding action causes cradle 50 to be locked, via primary latch 90 into the position illustrated by FIG. 8.

Mechanism 20 is now ready to apply a closing force to crank pin 22 has discussed herein and above.

It is noted that a substantial amount of force or moment force will be applied to a point of securement between cradle 50 and sidewall 24. In particular, end portions 64 of cradle mounting pin 62 are loaded with this force. However, the present invention limits or reduces this moment force to a minimum by positioning and mounting cradles 50 and linkage mechanisms 30 in close proximity to sidewalls 24 whereby the length of end portions 64 is minimized.

In addition, the moment force applied to end portions 64 is also reduced by the utilization of two cradles and two linkage mechanisms thereby effectively reducing the moment force by half.

In contrast, mechanisms that are located intermediate to the sidewalls will exacerbate the moment force of the pin mounted to the sidewall. This moment force is increased by virtue of an extended pin that has a force applied to it.

Figure 13:
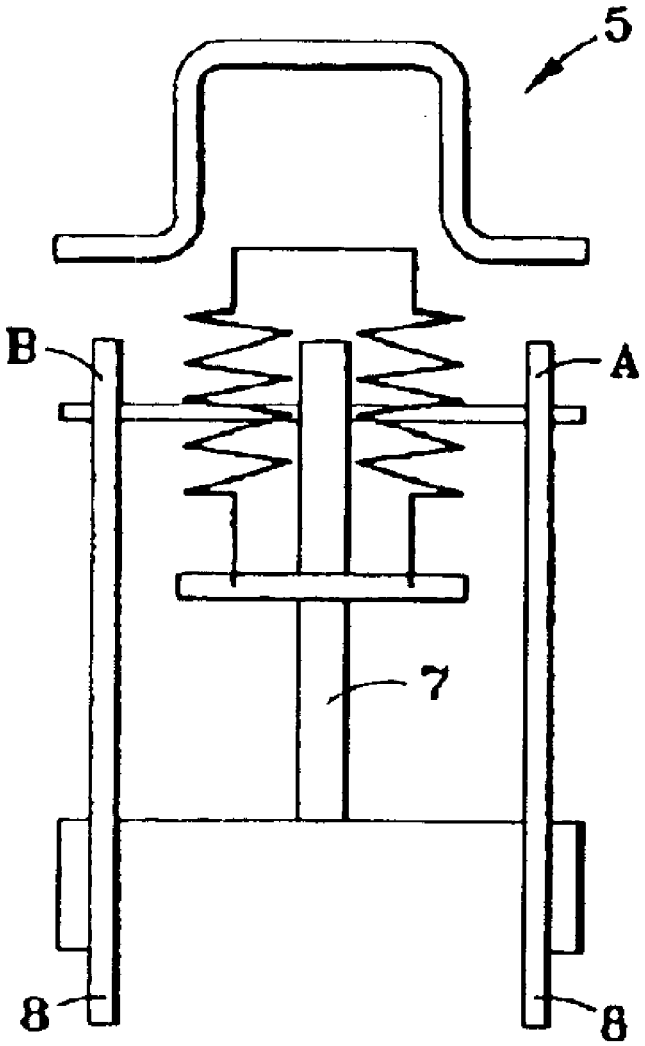
FIG. 13 PRIOR ART
FIG. 13 is a view of prior art.

For example, and referring now to FIG. 13, a mechanical mechanism 5 for placement over a single cassette body has a single linkage mechanism 7. Linkage mechanism 7 is positioned intermediate to a pair of sidewalls 8 and is secured to the same by a pin 9. This positioning of mechanism 7 causes a large moment force to be applied at points A and B as a force is applied to mechanism 7 to close or open a circuit interrupter. Moreover, if the distance between sidewalls 8 is increased the moment force at points A and B is even greater.

Since a substantial amount of the mechanical parts of mechanism 20 are mounted, configured and/or positioned to operate on side frames 24 it is contemplated in accordance with the present invention that the mechanical parts of the mechanism 20 can be applied to a circuit breakers having various configurations or poles.

Therefore, the present invention also allows a circuit breaker mechanism 20 to be configured to apply an operational force to a circuit having multiple phases or cassettes.

For example, mechanism 20 can be configured to be positioned over a single cassette body or over a plurality of cassettes bodies.

For example, and in comparison to a mechanism configured for placement over a single cassette body, the linkage mechanisms 30, side frames 24 and other mechanical parts are generally the same while the frame pins 28, toggle pin 32 and handle yoke 26 are altered to provide mechanism 20 with a wider configuration that will allow mechanism 20 to be placed over a pair of cassette body portions. Moreover, and in order to accommodate circuit breakers with multiple phases or cassettes, mechanism 20 is not adversely affected by higher loading forces as mechanism 20 is provided with a wider configuration. This is due to the utilization of two linkage mechanisms 30 and a pair of cradles 50 which are mounted to each of the sidewalls 24.

Accordingly, and as contemplated in accordance with the present invention, a symmetrical loading apparatus for any phase configuration of a circuit breaker will have similar mechanical parts. Therefore, the present invention provides a most economical means for manufacturing and supplying a symmetrical loading apparatus.

For example, and referring now to the dashed lines in FIG. 2, mechanism 20 can be used with a six phase circuit breaker. Here sidewalls 24, linkage mechanism 30 and cradle 50 are properly placed to apply asymmetrical force to crank pin 22. Of course, it is understood that mechanism 20 can be configured to be used with any number phase configuration regardless of whether there is an evening or odd number of phases.

Referring now to FIGS. 8 and 9, and for purposes of illustrating the movement of circuit interruption mechanism 21 in response to the movement of mechanism 20, portions of a circuit interrupter mechanism 21 are illustrated. Circuit interrupter mechanism 21 has, among other elements, a movable contact assembly 92, a line strap 94, a load strap 96, a pair of stationery contacts 98 and a pair of movable contacts 100.

Line strap 94, load strap 96, stationary contacts 98, movable contacts 100 and movable contact assembly 92 generally complete the circuit from an electrical supply line to a given load.

FIG. 8 illustrates circuit interrupter mechanism 21 in an open position while FIG. 9 illustrates circuit interrupter mechanism 21 in a closed position.

Movable contact assembly 92 has a pair of openings 102. Openings 102 are of a sufficient size to allow crank pin 22 to pass through.

In addition, and as handle 38 is moved to the closed position illustrated in FIG. 9, crank openings 44 make contact with crank pin 22 and urge pin 22 to travel through a pair of elongated openings 76 in side frames 24. As crank pin 22 travels from the position illustrated in FIG. 8 to the position illustrated in FIG. 9 crank pin 22 also makes contact with opening 102 and manipulates the circuit interrupter mechanisms of cassettes 12–18.

In order to apply an even or symmetrical force to the portion of crank pin 22 that passes through openings 102 in circuit interrupters 21 of cassettes 12, 14, 16 and 18. Mechanism 20 is configured to apply a force to crank pin 22 at two locations, namely, in between cassettes 12 and 14 and cassettes 16 and 18.

Figure 3:
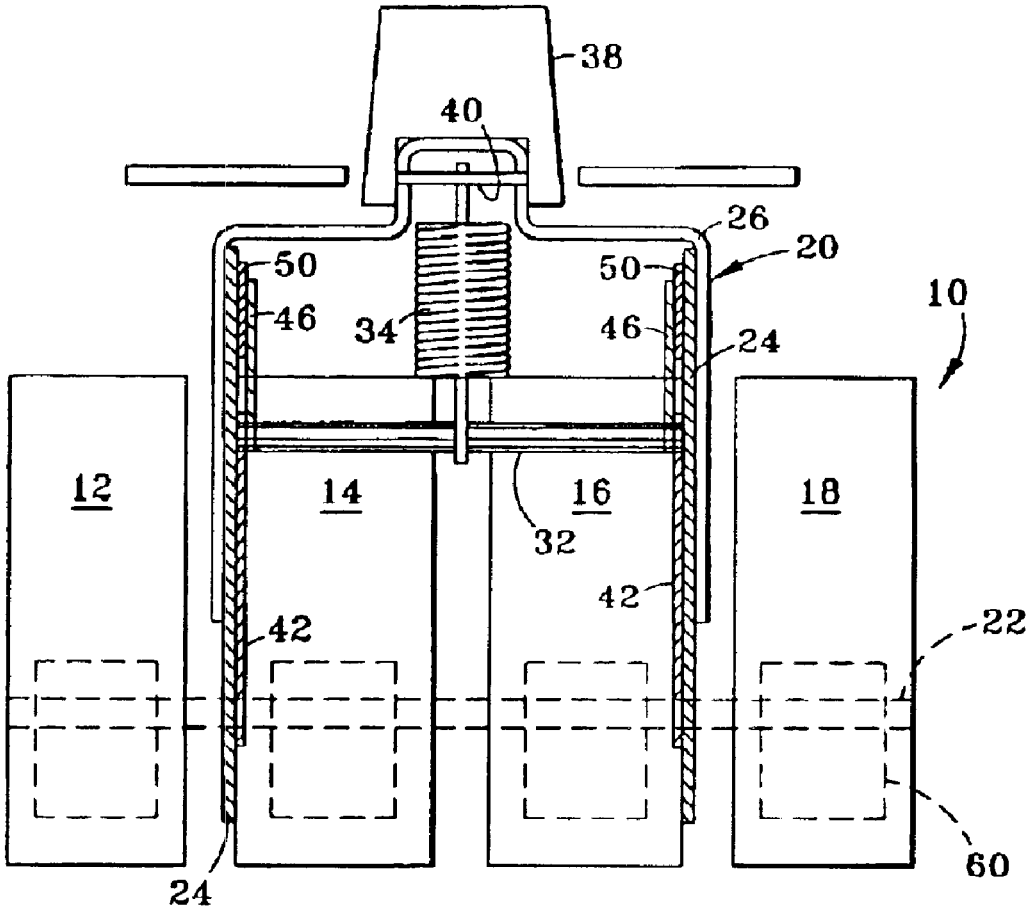
FIG. 3 is a view along the lines 3—3 of the FIG. 2 embodiment.
Figure 4:
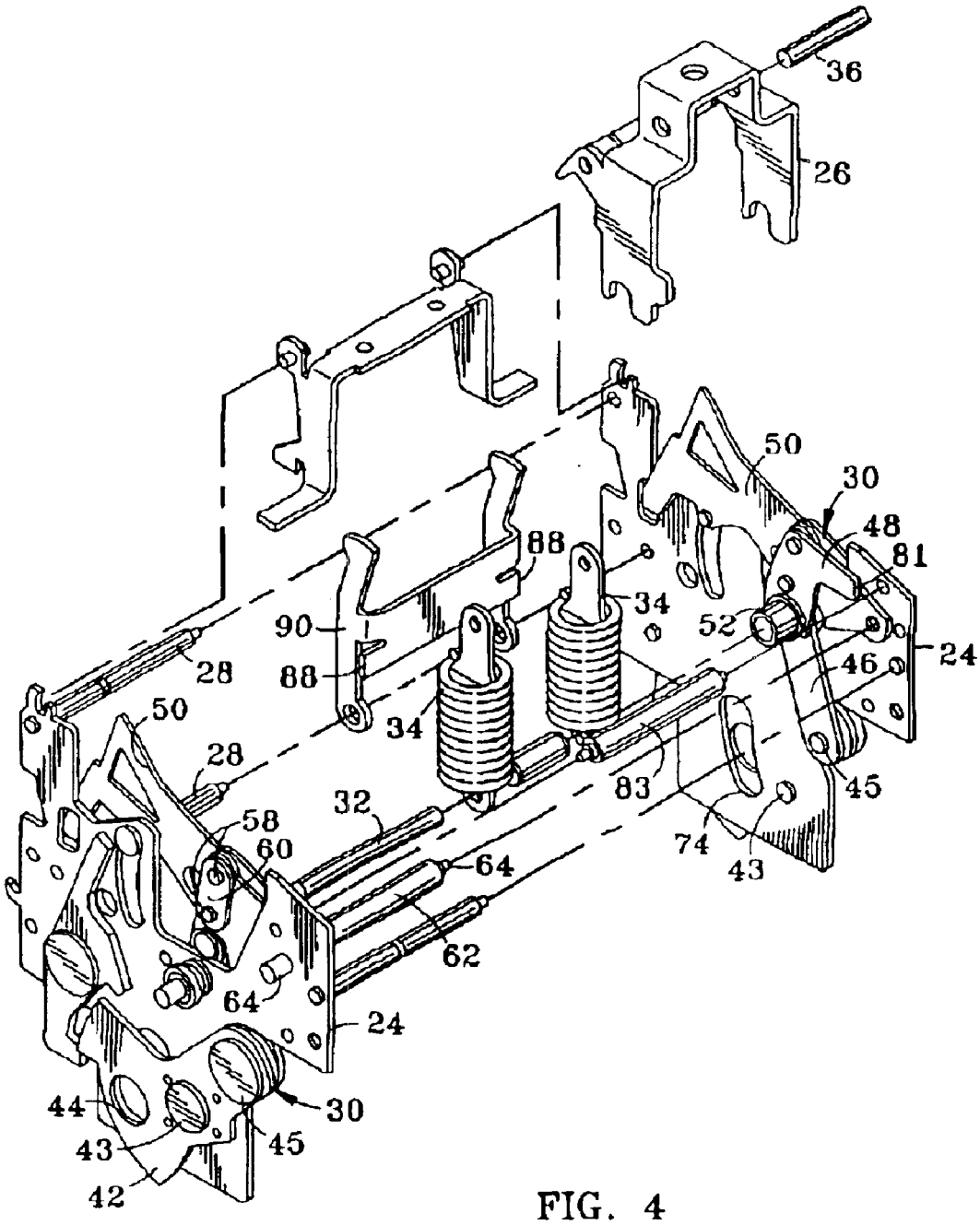
FIG. 4 is an exploded view of the present invention.
Figure 5:
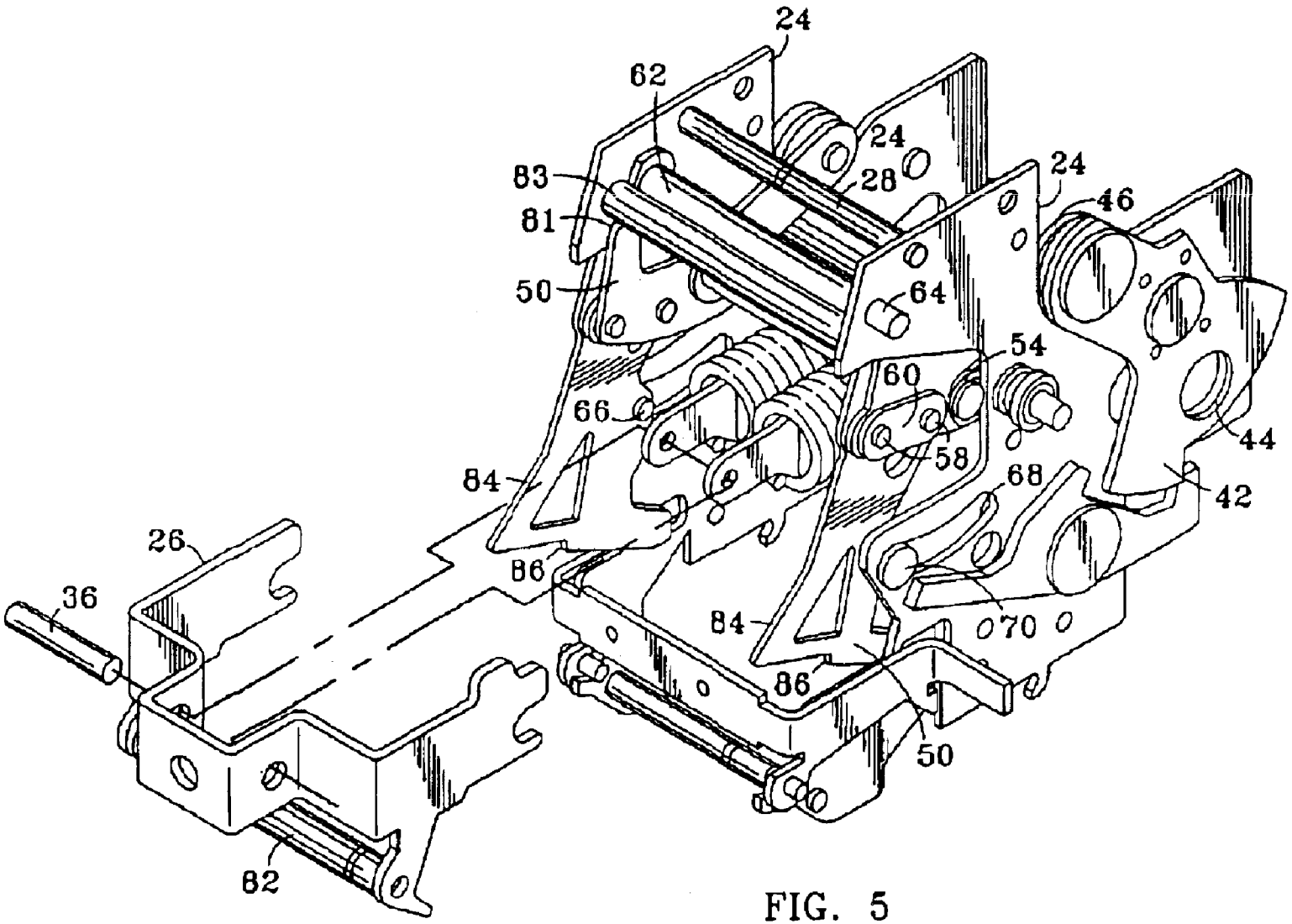
FIG. 5 is a partially exploded view of the present invention.
Figure 6:
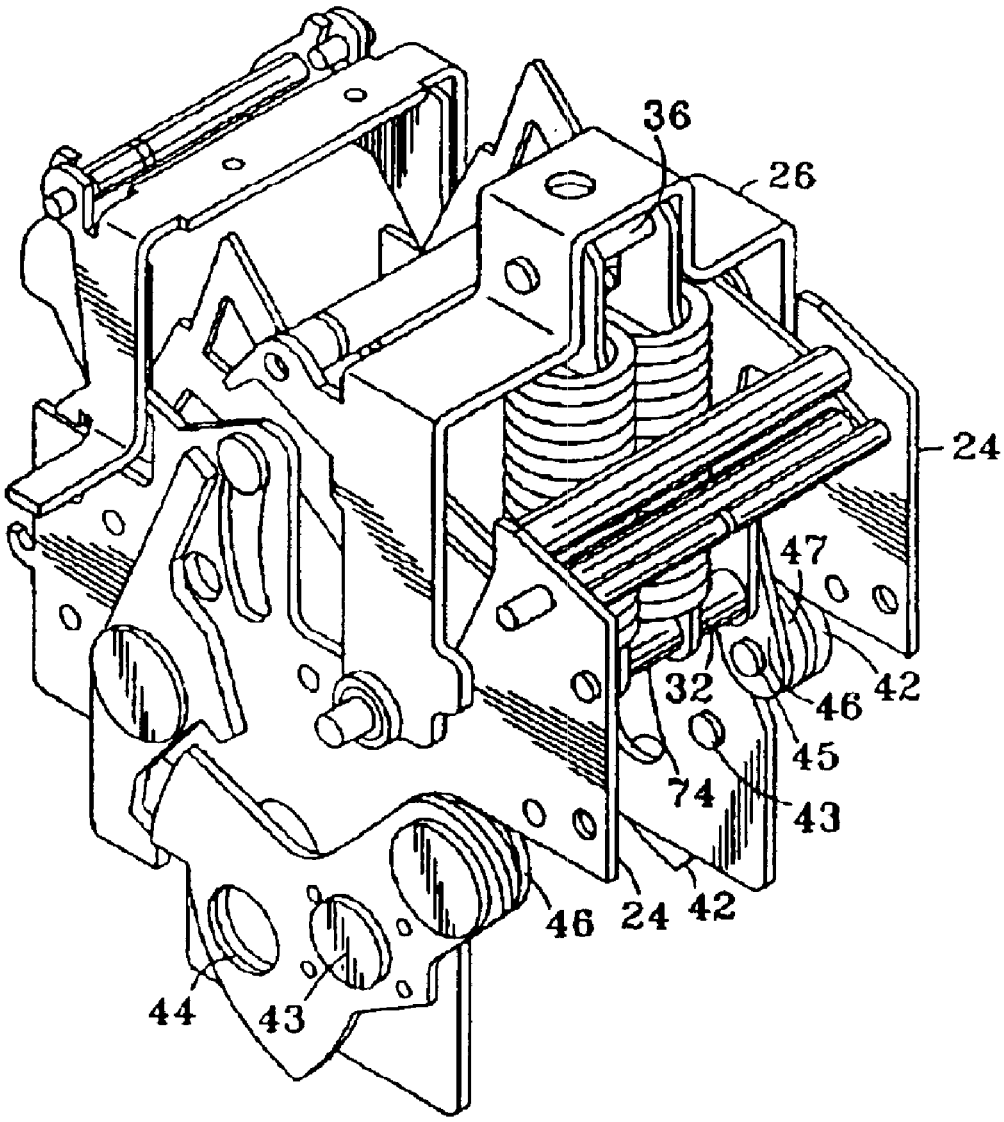
FIG. 6 is a perspective view of the present invention.
Figure 7:
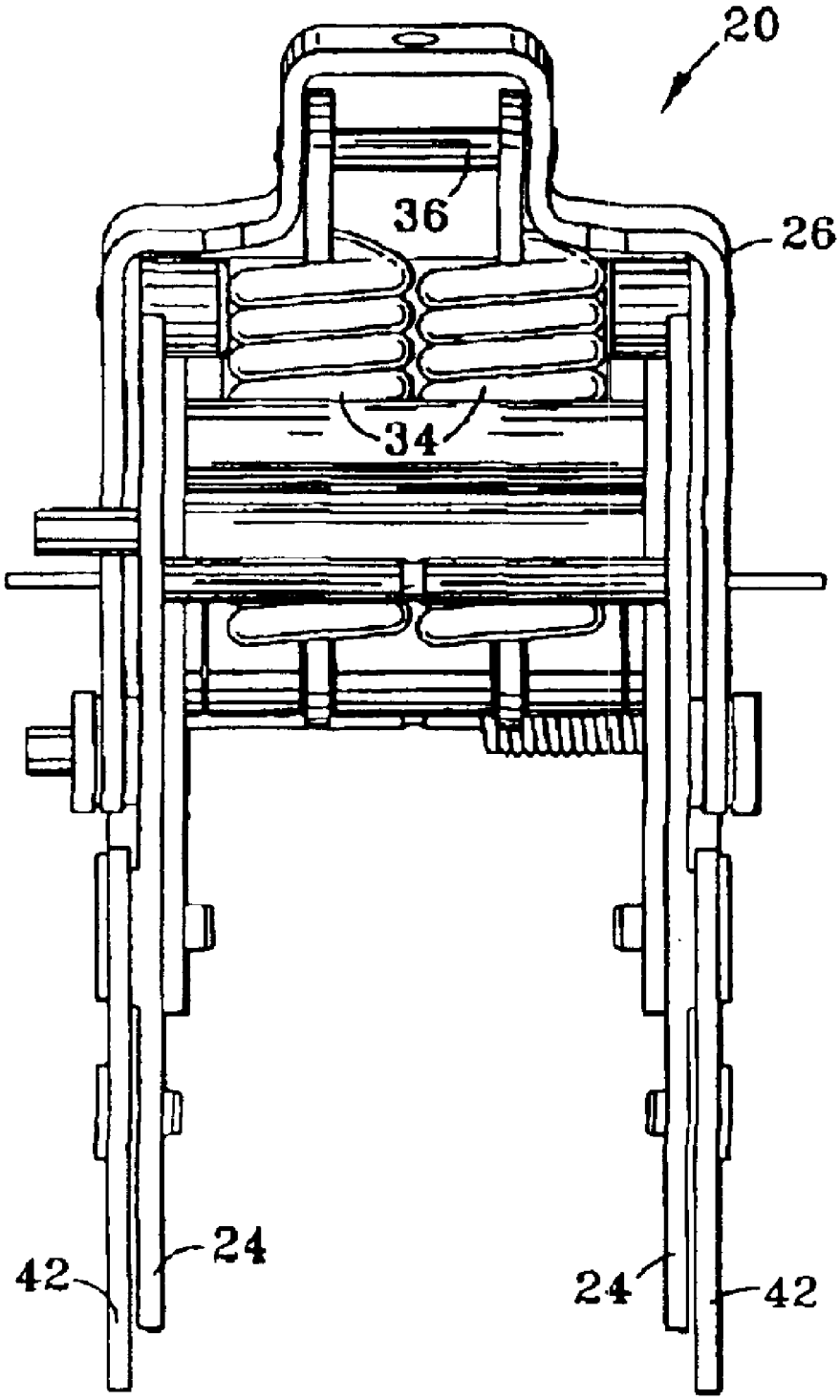
FIG. 7 is a front elevation view of the present invention.

Referring now in particular to FIGS. 2 and 3, a four phase circuit breaker is illustrated. Here operating mechanism 20 and more particularly, side frames 24 are positioned along the outer walls of the innermost cassettes 14 and 16. This positioning of operating mechanism 20 allows for the applied force of operating mechanism 20 to be applied upon crank pin 22 at a positioned in between cassettes 12 and 14 and cassettes 16 and 18. This allows a uniform force, from crank pin 22, to be applied to the circuit interrupter of each of the cassettes.

In addition, the configuration of handle yoke 26 allows spring 34 to be positioned in the gap located in between cassettes 14 and 16. This allows the lower portion of spring 34 to be secured to toggle pin 32 at a position lower than the upper surface of cassettes 12–18. This allows mechanism 20 to utilize a larger spring 34 as the design of mechanism 20 is not limited by the upper surface of the cassette body portions, as would be the case in a mechanism that is positioned over a single cassette.

Accordingly, and through the use of a larger spring 34, mechanism 20 is capable of applying a larger force to be circuit interrupters of cassettes 12–18. Moreover, this force is applied symmetrically throughout the circuit breaker. In addition, and since two cradles 50 and a pair of linkage mechanisms 30 are utilized the moment force of a larger spring is easily handled by the configuration of mechanism 20.

Referring now to FIGS. 11 and 12, an alternative embodiment of the present invention is illustrated, here component parts performing analogous or similar functions are numbered in multiples of 100.

In this embodiment handle yoke 126 and, accordingly, handle 138 is configured to align with a single pole or cassette of a four phase circuit breaker. This feature is a particular importance in applications where both three and four pole circuit breakers are being utilized.

The placement of handle 138, as illustrated in FIG. 11, makes the four pole circuit breaker of FIGS. 11 and 12 compatible with certain types of the equipment that utilize both three and four pole circuit breakers.

In addition, such a configuration allows for the alignment of the handles of a plurality of circuit breakers regardless of the type of being used.

As an alternative, and since handle 138 is positioned directly over cassette 116, a pair of springs 134 are secured to pin 136 and toggle pin 132.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit breaker comprising:

a) a first, second, third and fourth pole, each of said poles having a circuit interruption mechanism said circuit interruption mechanism of said first, second, third and fourth poles being manipulated from an open position to a closed position by an elongated member that passes through an opening in an actuation member of each of said circuit interruption mechanisms of said first, second, third and fourth poles, said second pole being positioned intermediate to said first pole and said third pole, said third pole being positioned intermediate to said second and said fourth pole;

b) a single opening mechanism for applying a force to said elongated member, said operating mechanism applying a force to said elongated member at a first position and a second position, said first position being intermediate said first and second poles and said second position being intermediate said third and fourth poles.

2. A circuit as in claim 1, wherein said first, second, and third poles each represent a phase of a three phase circuit and said fourth pole is a neutral.

3. A circuit breaker as in claim 1, wherein said handle operating mechanism further comprises:

i) a pair of sidewalls each having an inner and outlet surface, one of said pair of sidewalls being positioned at said first position and the other being positioned at said second position;

ii) a handle yoke being pivotally mounted to said pair of sidewalls for movement between a first position and a second position on said outer surface of said pair of sidewalls;

iii) a pair of engagement arms one of said engagement arms being mounted for movement on one of said outer walls and the other being mounted for movement on the outer surface of the outer side wall; and iv) a pair of linkage mechanism being coupled to said handle yoke at one end and said pair of engagement arms at the other, said pair of linkage mechanisms being configured, dimensioned and positioned to manipulate said pair of engagement arms from an open circuit position to a closed circuit position as said handle yoke is moved from said first position to said second position, said closed circuit position causing said elongated member to close said circuit interruption mechanism of said first, second, third and fourth poles; and v) a spring being positioned in between said sidewalls and being secured to said handle yoke at one end and a pin at the other, said pin being secured to each of said pair of linkage mechanisms, said spring being stretched as said handle is manipulated to said second position from said first position, said spring provides a biasing force to urge said linkage mechanisms into said closed position as said handle yoke is moved to said second position.

4. A circuit breaker as in claim 3, wherein said handle yoke is configured to receive and support a handle.

5. A circuit breaker as in claim 3, wherein a pair of springs provide a biasing force to urge said linkage mechanisms as said handle yoke is moved to said second position.

6. The method of providing a symmetrical force to an operating arm of a four pole circuit interruption mechanism, comprising:

determining a center of a crank pin for applying forces to an operating arm, said crank pin in operable communication with each pole of the four poles circuit interruption mechanism, and applying a force to said crank pin at a first position and a second position, said first and second positions being equidistant from the center of said crank pin, said force being applied by a single operating mechanism.

7. The method as in claim 6, further comprising:

providing a pair of linkage mechanisms for applying said force to said crank pin, said linkage mechanisms being located at said first and second positions.

* * * * *